US009272288B2

(12) United States Patent
Lakhmiri

(10) Patent No.: US 9,272,288 B2
(45) Date of Patent: Mar. 1, 2016

(54) METHOD AND SYSTEM FOR THE CONDITIONING OF RAW BIOMASS

(71) Applicant: LAKSON INTERNATIONAL DEVELOPMENT INC., Ville St-Laurent (CA)

(72) Inventor: Mohammed Simo Lakhmiri, Kirkland (CA)

(73) Assignee: LAKSON INTERNATIONAL DEVELOPMENT INC., Ville St-Laurent (CA)

( * ) Notice: Subject to any disclaimer, the term of this patent is extended or adjusted under 35 U.S.C. 154(b) by 267 days.

(21) Appl. No.: 13/801,174

(22) Filed: Mar. 13, 2013

(65) Prior Publication Data

US 2014/0263769 A1 Sep. 18, 2014

Related U.S. Application Data

(60) Provisional application No. 61/614,576, filed on Mar. 23, 2012.

(51) Int. Cl.

| | |
|---|---|
| ***B02C 21/00*** | (2006.01) |
| ***B02C 23/24*** | (2006.01) |
| ***B02C 23/12*** | (2006.01) |

(52) U.S. Cl.

CPC ..... *B02C 21/00* (2013.01); *B02C 23/12* (2013.01); *B02C 23/24* (2013.01)

(58) Field of Classification Search

CPC ..... B02C 21/00; B02C 23/08; B02C 23/24
USPC ..... 241/19, 24.11
See application file for complete search history.

(56) References Cited

U.S. PATENT DOCUMENTS 4,293,334 A * 10/1981 Drobot et al. ..... 423/22
7,481,385 B2 * 1/2009 Narayan et al. ..... 241/19

* cited by examiner

*Primary Examiner* — Mark Rosenbaum
(74) *Attorney, Agent, or Firm* — Goudreau Gage Dubuc; Gwendoline Bruneau

(57) ABSTRACT

A biomass conditioning system and method, the system comprising a chamber and an airflow loop, the chamber comprising a lower part adapted to receive biomass and comprising grinding elements, cutting elements and an air input, an airflow from the air input and rotation of the elements creating an uplifting; and an upper part comprising an inner chamber generally centered within an outer chamber, the outer chamber comprising a first outlet and the inner chamber comprising a second outlet; and a flange selectively connecting the lower part with the inner chamber and the lower part with the outer chamber; and the airflow loop comprising a source of input air in the lower part, a first exhaust connected to the first outlet and evacuating air and biomass particles from the inner chamber, and a second exhaust connected to the second outlet and evacuating mist and air from the outer chamber; in which the flange diverts, from the uplifting vortex and under action of a vacuum created between the air input and the second outlet, a water particle flow to the first outlet of the outer chamber and a biomass particles flow towards the inner chamber; light biomass particles being propelled up the inner chamber the second outlet.

7 Claims, 3 Drawing Sheets

METHOD AND SYSTEM FOR THE CONDITIONING OF RAW BIOMASS

CROSS REFERENCE TO RELATED APPLICATIONS

This application claims benefit of U.S. provisional application Ser. No. 61/614,576, filed on Mar. 23, 2012. All documents above are incorporated herein in their entirety by reference.

FIELD OF THE INVENTION

The present invention relates to biomass. More specifically, the present invention is concerned with a method and a system for conditioning of raw biomass.

BACKGROUND OF THE INVENTION

Biomass material is increasingly used as a source of thermal energy and to produce bio-plastics and other renewable bio-products. For instance, some residential, institutional and industrial buildings have already been designed or converted to use biomass pellets, instead of fossil fuels, for heating and/or process use. Overall, a number of equipment, including dryers, boilers, and furnaces, continue to be converted to biomass use, instead of fossil fuels. Moreover, recent developments in the forestry field show that wood derivatives, such as nanocrystalline cellulose, may substitute fossil originating chemicals in the production of plastics, textile and other products.

The biomass material used in these applications is typically sourced from waste streams in a number of industries, including the extraction and transformation of wood and agricultural products. In their raw form, biomass by-products usually have a high moisture content and a large particle size, making them ill-suited for direct use in modern biomass applications.

In some cases, raw biomass by-products are used directly in thermal processes, using out-dated and conventional methods, such as moving grate or fluidized bed technologies, which implicates large-sized equipment. This approach results in important energy losses in the process, as well as high levels of flue gas emissions requiring more elaborate emission control systems.

In order to tackle these limitations, conditioning processes of the raw biomass have been developed. The raw biomass is dried to a moisture content of 10% or less, and is grinded to a particulate size ranging from a few microns to a few millimeters, depending on the application.

Typically, the biomass industry relies on a combination of grinders and rotary dryers to perform the above-described conditioning process. This solution is problematic, because the drying system itself relies on a burner which burns some of the dried biomass, in order to provide heating energy for the raw biomass; therefore, an emission control system is a necessary addition to this configuration. Moreover, there are overwhelming capital requirements implicated in the installation of rotary dryers and necessary auxiliary systems, as well as the construction of large-sized building to house the entire system.

In general, all types of dryers (including rotary dryers, flash tube dryers, etc.) rely on a thermal process which i) cannibalizes a portion of the dry biomass production to feed a burner that provides heating energy to raw biomass, ii) requires an emission control system to treat flue gases, and iii) implicates a capital requirement that is uneconomical for small and medium plant capacities.

Furthermore, the existing biomass drying and grinding technologies that are currently used to perform the conditioning process are unsteady, energy inefficient and/or have a limited dewatering capacity. In particular, these technologies commonly exhaust vapour and heated air from the drying chamber; in this manner, thermal energy is actually evacuated and therefore wasted from the process.

Some technologies recycle saturated air in the drying chamber, which effectively limits their ability to dewater raw biomass. As the 'recycled' air becomes saturated with moisture, it is unable to absorb further moisture. These technologies operate at low temperature, resulting in water condensation and, therefore, in a sticky biomass build-up in the drying chamber and in the single cyclone.

There is therefore a need in the art for a method and a system for conditioning raw biomass.

SUMMARY OF THE INVENTION

More specifically, in accordance with the present invention, there is provided a biomass conditioning system, comprising a chamber, the chamber comprising: a lower part adapted to receive biomass, the lower part comprising grinding elements, cutting elements and an air input, an airflow from the air input and rotation of the elements creating an uplifting vortex in the lower part; and an upper part, the upper part comprising a partition comprising an inner chamber generally centered within an outer chamber, the outer chamber comprising a first outlet and the inner chamber comprising a second outlet; and a flange selectively connecting the lower part with the inner chamber and the lower part with the outer chamber; and an airflow loop, the airflow loop comprising a source of the input air in the lower part, a first exhaust connected to the first outlet and a second exhaust connected to the second outlet, the first exhaust evacuating air and biomass particles from the inner chamber, and the second exhaust evacuating mist and air from the outer chamber; wherein the flange diverts, from the uplifting vortex and under action of a vacuum created between the air input and the second outlet, a water particle flow to the first outlet of the outer chamber and a biomass particles flow towards the inner chamber; light biomass particles being propelled up the inner chamber to the second outlet.

There is further provided a biomass conditioning method, by separating water particles from biomass particles in a chamber, using an airflow and a centrifugal force, comprising selectively directing the water particles to a first outlet of the chamber, and the biomass particles, depending on their weight, to a second outlet of the chamber.

Other objects, advantages and features of the present invention will become more apparent upon reading of the following non-restrictive description of specific embodiments thereof, given by way of example only with reference to the accompanying drawings.

DESCRIPTION OF EMBODIMENTS OF THE INVENTION

A conditioning method and system will be described in relation to the illustrative embodiment of FIGS. 1 to 3.

Figure 1:
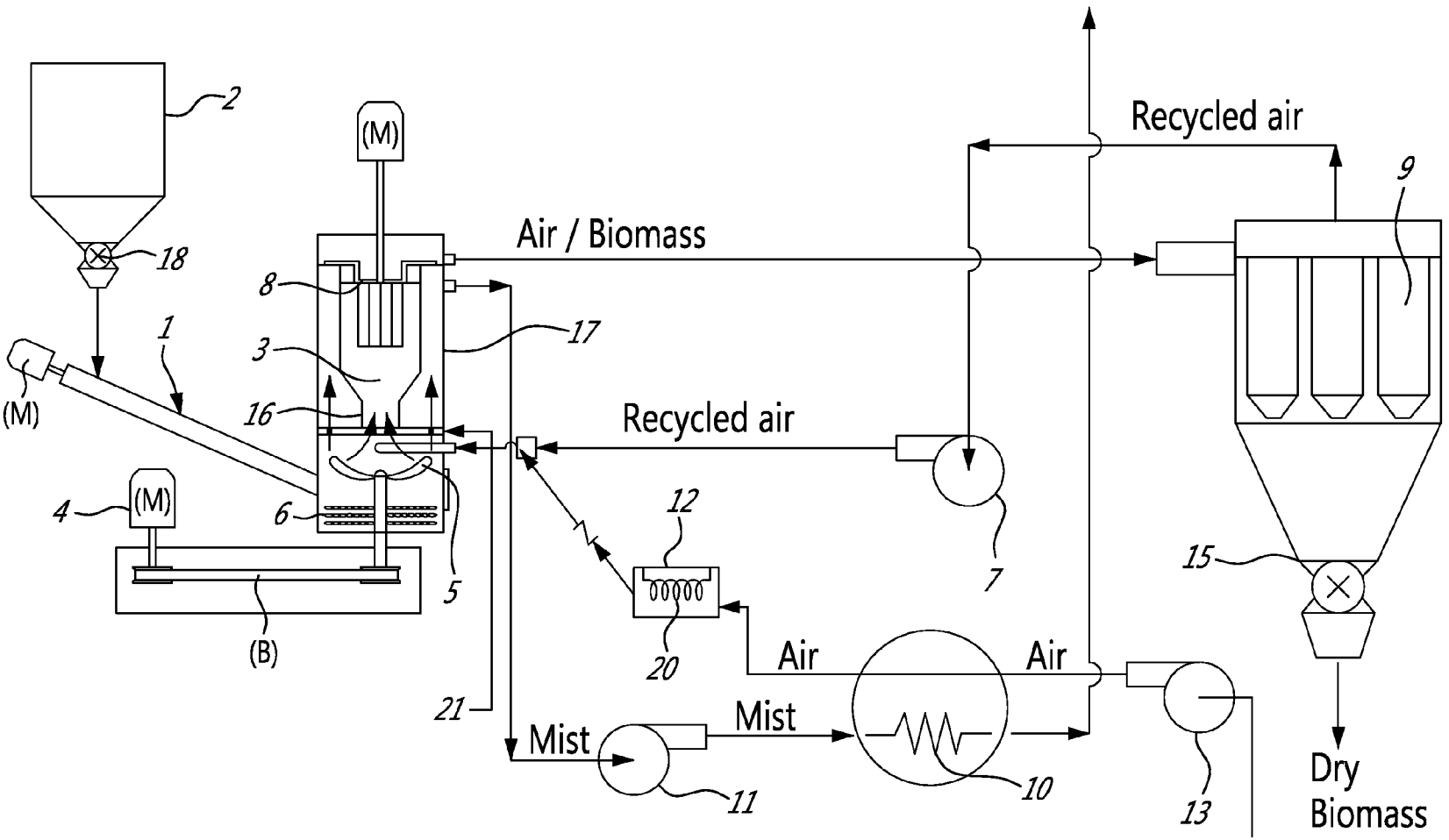
FIG. 1 is a schematic representation of a conditioning system according to an embodiment of an aspect of the present invention.

As illustrated in FIG. 1, biomass is accumulated in a feeding hopper 2 and is fed to the conditioning system using a conveyor 1, such as a screw conveyer for example. The hopper 2 is provided with an airlock valve 18 allowing the biomass onto the conveyor 1, which transports the biomass, typically as chunks of biomass, into a lower part of a chamber 3.

The lower part of the chamber 3 comprises a vertical shaft, upon which chains 6 and blades 5 are attached. Using a power transmission system 4 composed of pulleys, a multi-belt transmission (B) and a motor (M) for example, the shaft is spun at high speed, for example 1200 rpm and more, for example at 1500 rpm; thus forcing the chains 6 and blades 5 and to spin at a required speed for a grinding action on the biomass chunks by the chains 6, and a cutting action on biomass chinks, of a reduced size after grinding by the chains 6, by the blades 5. For this purpose, variable speed motors may be used.

As the biomass falls onto the bottom of the chamber 3, it is thus repeatedly grinded and chopped by the chains 6 and blades 5 into biomass particles. The biomass particles are then propelled upwards by an uplifting airflow generated by the blades 5 and by suction and vacuum created by air blown a within the chamber 3 in the lower part thereof by a blower 7, and returned thereto as recycled air. As the biomass is broken down into particles, the water content thereof is released into this airflow, thus reducing the biomass' moisture content. A portion of the superficial water is phased in the form of mist and is absorbed by the airflow in the exhaust 11.

In the upper level, the chamber 3 forms an outer cylinder 17 comprising an inner cylinder 6 generally centered in the outer cylinder 17, creating a cylindrical partition within the upper level of chamber 3.

As the biomass particles and water particles rise from the lower part of the chamber 3, they are forced into a spiral circular motion, by the air input which enters the chamber 3.

A flange 21 connects the lower part and the upper part of the chamber 3. The flange 21 is in the form of a torus and comprises a central orifice for connecting the lower part of the chamber 3 to the inner cylinder 16 and allowing the passage of biomass particles from the lower part to the inner cylinder 16, and lateral orifices at the extremities thereof for connecting the lower part of the chamber 3 to the outer cylinder 17 and allowing the passage of the water particles from the lower part to the outer cylinder 17. Along with the cylindrical partition within the chamber 3, the flange 21 thus allows the diversion of the water particles flow toward the outer cylinder 17 and exhaust 11, and channeling the biomass particles flow towards the inner cylinder 16.

A cylindrical configuration of the chamber 3 is described, but any rotational symmetry configuration, such as an hexagonal configuration, may be used.

The shape of the chamber 3 allows using centrifugal force to separate water from the biomass particles. Given that water particles have a higher density than dry/fine biomass particles, and that the centrifugal force is proportional to the weight of the particles, the dry/fine biomass particles rotate closer to the center of the chamber 3 than the water particles, which rotate closer to the lateral walls of the chamber 3. The cylindrical partition within the chamber 3 allows the diversion of the water particle flow toward the exhaust 11 of the outer cylinder 17, and of the biomass particle flow towards the inner cylinder 16.

As the biomass particles reach the level of the flange 21 in the chamber 3, they are sucked in by the inlet of the inner cylinder 16 through the central orifice of the flange 21. Since the particles rotate on average at the same speed and depending on the equilibrium between the centrifugal force and the forces related to the motion of the vortex air, the heavier biomass particles tend to rotate further from the center of rotation, thus hitting the inner walls of the inner cylinder 16 and falling back down to the lower part of the chamber 3 through the central orifice of the flange 21, where they are subjected again to the grinding, chopping and dewatering operation described hereinabove, until they are sufficiently light to be propelled up to the top of the inner cylinder 16 by the conveying air.

A sizer 8 is positioned at the top of the inner cylinder 16. The biomass particles enter the sizer 8, which sorts the biomass particles by size: only those biomass particles that are sufficiently small are allowed through the sizer 8, whereas the balance of the particles is returned to the bottom of the chamber 3 through the central aperture in the flange.

Therefore, by forcing the biomass particles into the inner cylinder 16 and into the sizer 8, only the biomass particles with a sufficiently small moisture content and particle size are allowed to exit the chamber 3, in a flow of air/biomass particles conveyed towards a multi-cyclone 9, in which the biomass powder can be separated from the conveying airflow, and collected, at the bottom of the multi-cyclone 9, through an airlock valve 15 for example.

Given that the temperature of the exhaust air is higher than that of ambient air, energy can be recovered by recycling the conveying airflow used to transport the biomass particles to the multi-cyclone 9. To that effect, a blower 7 sucking air from the top of the multi-cyclone 9 may be used to send the conveying air back to the chamber 3 at the lower part thereof. At the same time, heated ambient air (see ambient air blower 13) is used to make-up the balance in airflow required for injection into the chamber 3 at the lower part thereof, in replacement to the exhaust.

Back inside the chamber 3, as the water particles airflow reaches higher levels in the outer cylinder 17, it is exhausted out and into a heat exchanger 10, using an exhaust fan 11. Given that the temperature of the exhaust airflow is higher than that of ambient air, the system is able to recuperate an important part of the energy it uses by exchanging the energy of the exhaust airflow onto ambient air. This mechanism also prevents the reintroduction of a moisture-saturated airflow into the chamber 3 and therefore helps increase the dewatering capacity of the injected air into the system.

Using a blower 13, ambient air is sent to the heat exchanger 10, where it receives energy from its hot side, i.e. form the exhaust air/mist (from blower 11). The heated air may be directed into an electrical duct heater 12, in order to control its temperature and humidity to a desired level, before reuniting with the flow of recycled air made to enter the chamber 3. Alternatively, a heat pump could also be used to increase the temperature of the input air. In addition and when available, it is also possible to inject heat from an external source 20 into the duct heater 12. The heater 12 is only activated if the incoming air's temperature is inferior to the temperature inside the chamber 3; in this case, it is activated so as to heat the make-up air to the temperature of the chamber 3. Typically, the air made to enter the lower part of the chamber 3 has a temperature between about 50 and about 70° C., for example of about 70° C., for efficient moisture absorption.

The combination of heated ambient air and recycled air is made to enter the chamber 3 in the lower part of the chamber 3. Using a tangential air input at a downward angle may ease creating a vortex in the lower part of the chamber 3. Given its temperature, the hot airflow facilitates the system's drying and sorting operations. The hot airflow into the system is controlled by a control panel so as to ensure that temperature inside the chamber 3 remains within an operational range, typically between 50° C. and 70° C. As the temperature inside the chamber 3 is maintained below water boiling point, the drying of the biomass is achieved mainly in the liquid phase, as a mist, evacuated from the chamber 3 by an outlet on an upper level of the outer cylinder 17 as described hereinabove.

The action of the exhaust fan 11 creates a negative pressure inside the chamber 3; which reduces the quantity of thermal energy required to evaporate the biomass' surface water particles, and increases the release of water particles that are trapped in biomass particles.

A control system may be designed to ensure that the system works efficiently. This control system is used to control the temperature of the recycled/ambient air combination entering the chamber 3, as well as the operating pressure inside the chamber 3. The operating pressure inside the chamber is kept negative.

A temperature sensor may be located between the heat exchanger 10 and the electrical heater 12 so as to monitor the temperature of the ambient air at the outlet of the heat exchanger 10. Another temperature sensor may monitor the temperature inside the chamber 3. When the temperature measurement of the ambient air sensor is significantly lower than that of the chamber sensor, the electrical heater may be activated; otherwise, the electrical heater 12 remains in off-mode.

The pressure inside the chamber 3 may be monitored, using a pressure sensor directly connected to the exhaust fan 11. If the pressure inside the chamber 3 becomes too high, the speed of the exhaust fan 11 is increased until the pressure inside the chamber 3 returns to its desired level.

When the biomass has a very high moisture content, i.e. with a moisture content of more than 50% by weight for example, such as sludge from a sewage treatment plant, which can have moisture content as high as 80% for example, the biomass may be sticky. In order to ease processing by the conditioning system of the present invention as described hereinabove in relation to FIG. 1, a pre-drying unit 100, as illustrated in FIG. 2 for example, may be used to lower the moisture content of the biomass before the biomass enters the conditioning system, using a feeding conveyer 300 as shown in FIG. 3 for example.

The biomass enters the pre-drying unit 100 through a hopper 104 located at the top of a drying chamber 108. An airlock 112 underneath the hopper 104, controlled by a variable frequency drive, allows controlling the flow of biomass entering the drying chamber 108. When the airlock 112 is opened, the biomass falls within the drying chamber 108 on conveyor unit, shown in FIG. 2 as a series of variable speed conveyors 116*a*, 116*b*, 116*c* arranged in cascade. Guides 120 are located on the inner side walls of the drying chamber 108 ensure that the biomass falls on the conveyors 116*a*, 116*b*, 116*c* and not beside it. Radiant heaters 122, such as halogen heating elements, are provided above each conveyor 116*a*, 116*b*, 116*c* to provide the biomass with radiant heat, to reduce its moisture content. The length and number of the radiant heaters 122, as well as the speed of the conveyors 116*a*, 116*b*, 116*c* are selected to maximize the drop in moisture of the biomass, i.e. depending on the nature and moisture content of the biomass.

Temperatures of the biomass and in the drying chamber 108 are monitored so that they do not exceed a temperature that may damage the conveyors 116*a*, 116*b*, 116*c*, by controlling operation of the radiant heaters 122 and evacuation of air from the drying chamber 108.

The vapor or mist generated within the drying chamber 108 is evacuated to an exhaust 138 therefrom by a blower 128 such as an induce fan located on the top of the drying chamber 108. The blower 128 may be a vacuum blower, and used to create a vacuum, i.e. a negative pressure in the drying chamber 108. Creating a vacuum in the drying chamber 108 allows reducing the input of thermal energy needed to separate the water from the biomass, based on the principle that water evaporates at lower temperature at high altitude than at sea level, due to the pressure of the air, which is much lower at high altitude than at sea level. Thus, creating a vacuum in the drying chamber 108 allows lowering the evaporation temperature of the water inside the drying chamber 108. Moreover, a vacuum enhances the physically removal of water from the wet biomass, by using the air removed from the drying chamber 108 as a pneumatic conveyor to convey the fine droplets of water located on the wet biomass to the outside of the drying chamber 108.

The outlet of the vacuum blower 128 may be connected to an ac cyclone 132 for recuperating biomass particles that may be carried by the air sucked out from the drying chamber 108 before the exhaust 138. The exhaust 138 of the drying system 100, evacuating air sucked out from the drying chamber 108, may be coupled with the air exhausted by the conditioning system of the present invention as described hereinabove in relation to FIG. 1 (see exhaust fan 11).

Figure 2:
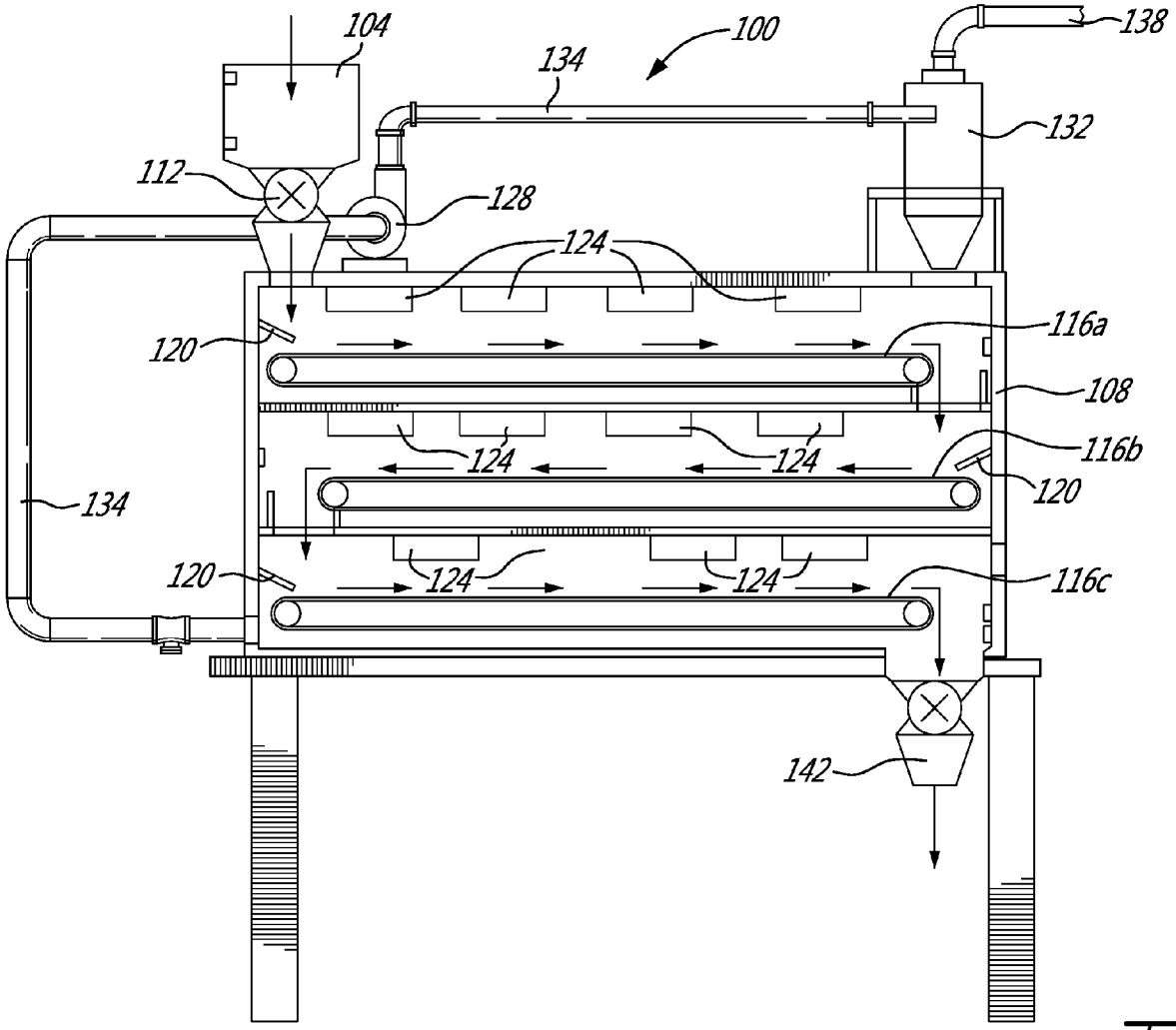
FIG. 2 is a schematic view of a pre-drying unit according to an embodiment of an aspect of the present invention.
Figure 3:
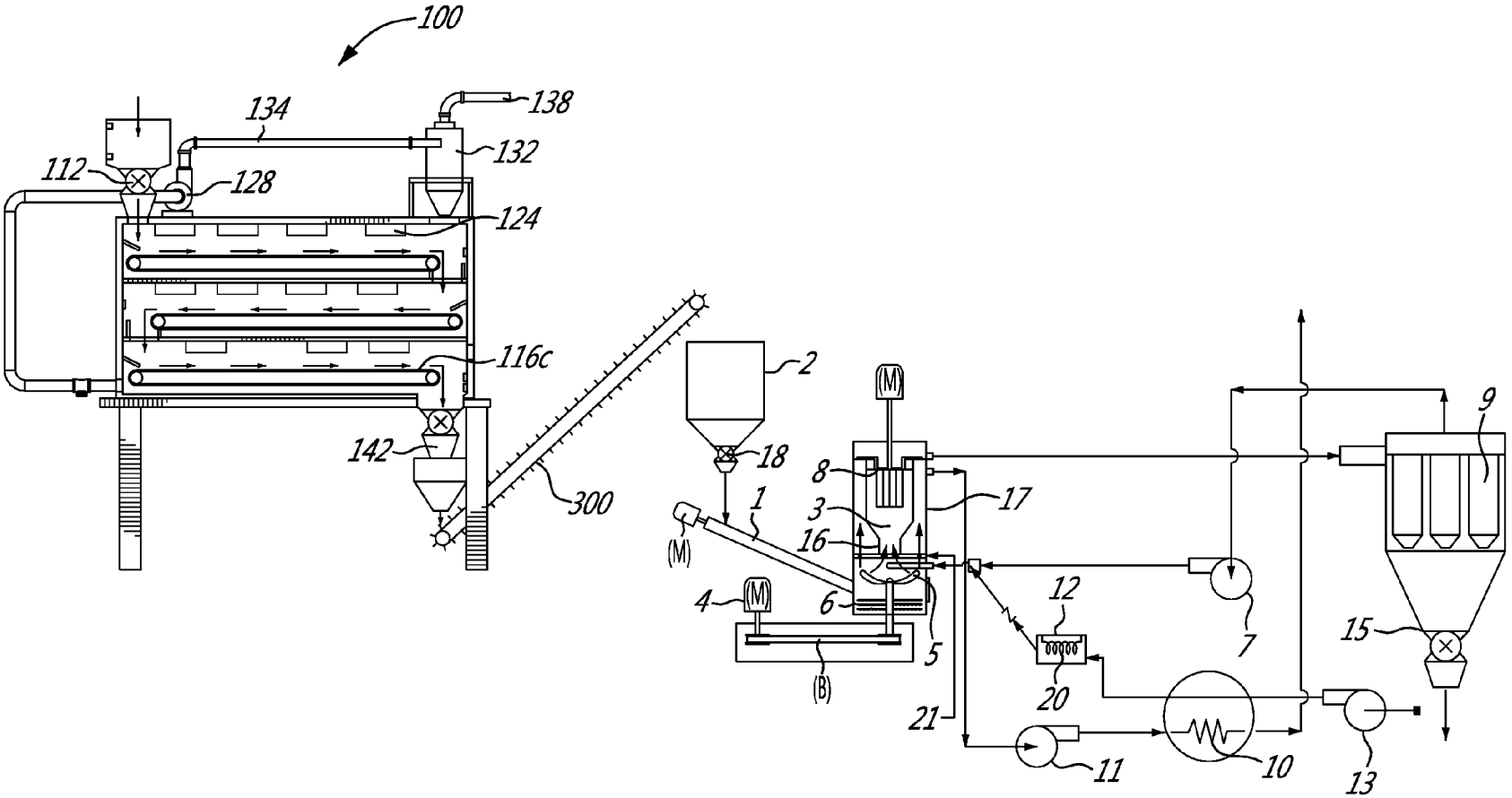
FIG. 3 is a schematic view of a system according to an embodiment of an aspect of the present invention.

Instead of a conveyor unit comprising a series of variable speed conveyors 116*a*, 116*b*, 116*c* in a staggered arrangement for compactness of the conveyor unit as illustrated shown in FIG. 2, the conveyor unit may comprise a long straight conveyor if more space is available on the ground for example.

The number of radiant heaters 122, the conveying length and the speed of the conveyors, in relation to the condition of the biomass at the input of the dryer system 100 and of the required biomass conditions at the outlet 142 for feeding to the conditioning system of the present invention as described hereinabove in relation to FIG. 1.

The present system and allow conditioning raw biomass powder into a dry fine powder while recuperating an important part of the energy that is evacuated in the form of exhaust vapour and heated air.

The biomass may originate from wood, such as waste or by-product of the forestry industry, or from other sources, such as agricultural and animal waste, or pulp and paper and wastewater sludge. If necessary and as a preparative measure, the raw biomass may be shredded to a size of a few inches, upstream of the system.

The resulting biomass powder may be used in a wide range of modern biomass applications, including for example the production of wood pellets and logs and bio-fuels in general, the production of heat using dust burners or the pyrolysis process, the production of nanocrystalline cellulose, the methanation process etc.

In a nutshell, the system delivers mechanical energy to the raw biomass, using blades and chains/or bars that are spun by an electric motor; the blades also acting as an internal fan generating an internal flow. Due to the important airflow generated within the system, light biomass particles become airborne while heavier biomass particles are forced back into the blades and chains to continue the dewatering/size reduction process. Furthermore, some of the thermal energy contained in the system's outgoing airflows is recuperated through the exhaust heat recovery system, whereas the moisture is prevented from re-entering the system. In addition, the moisture absorption capacity in the chamber is optimised The exhaust system is designed to create a vacuum, i.e. a negative pressure, in the chamber, which, given the temperature of operation in the chamber, facilitates the partial evaporation of moisture and hence increases the dewatering capacity of the system.

Generally stated, the process comprises feeding raw biomass to the lower part of the chamber of the system, in which the biomass is crushed by repeated impact with blades and chains; injection of a dry, hot tangential airflow from the heat recovery system into the system; separation of water particles, light biomass particles and heavy biomass particles using the centrifugal force; separation of oversized biomass particles using a rotating size selecting device, referred to as the sizer; high efficiency separation of biomass particles from its conveying airflow using a multi-cyclone; recycling this conveying airflow into the system; recovery of thermal energy from the exhaust by ambient air using a heat exchanger; secondary heating of make-up air in an electrical duct heater; and injection of make-up air into the system.

The present method and system promote the use of conditioned biomass in the form of a dry/fine powder in biomass-to-energy applications in order to achieve important gains in process efficiency as well as important reductions in overall capital, operation and maintenance costs.

The present method and system allow a simultaneous grinding and drying operation on the raw biomass, yielding a dry/fine powder in an efficient manner. The present method and system allow conditioning raw biomass while achieving higher energy efficiency and dewatering capacity. As people in the art will appreciate, the present method and system allow end-users to condition biomass more economically, eliminate the need for additional equipment in thermal processes, and render modern biomass applications more viable and economical.

The scope of the claims should not be limited by the embodiments set forth in the examples, but should be given the broadest interpretation consistent with the description as a whole.

What is claimed is:

1. A biomass conditioning method, comprising:

receiving the biomass in a lower part of a chamber, the lower part of the chamber comprising rotating breaking elements and an air input injecting a dry, hot airflow; the airflow and the rotation of the breaking elements creating an uplifting vortex in the lower part of the chamber;

breaking up the biomass into biomass particles by mechanical impact with the breaking elements in the lower part of the chamber;

using the airflow and the uplifting vortex to extract water particles from the biomass particles and to selectively direct the water particles to a first outlet in an upper part of the chamber and resulting dried biomass particles, depending on their weight, to a second outlet in the upper part of the chamber, the upper part of the chamber comprising a partition comprising an inner chamber generally centered within an outer chamber, the outer chamber comprising the first outlet and the inner chamber comprising the second outlet, a flange selectively connecting the lower part of the chamber with the inner chamber and the lower part of the chamber with the outer chamber;

whereby the flange diverts, from the uplifting vortex and under action of a vacuum created between the air input and the second outlet, a water particle flow to the first outlet of the outer chamber and a biomass particles flow towards the inner chamber; light biomass particles being propelled up the inner chamber to the second outlet.

2. The biomass conditioning method of claim 1, comprising maintaining the chamber at a negative pressure and at a temperature below water boiling temperature.

3. The biomass conditioning method of claim 1, comprising recycling the airflow of at least one of: i) the first outlet and ii) the second outlet.

4. The biomass conditioning method of claim 1, comprising recycling heat from at least one of the first and the second outlets.

5. The biomass conditioning method of claim 1, wherein the airflow is a hot air flow generated by at least one of: i) heating ambient air using heat from the first outlet; ii) heating ambient air using a heating source; and ii) air recycled from the second outlet.

6. The biomass conditioning-method of claim 1, comprising heat from exhaust of the first and second outlets.

7. The biomass conditioning method of claim 1, further comprising pre-drying the biomass using heating elements in a negative pressure chamber.

* * * * *